US006386010B1

(12) United States Patent
Irie et al.

(10) Patent No.: US 6,386,010 B1
(45) Date of Patent: May 14, 2002

(54) SPINNING PROCESSING METHOD AND APPARATUS THEREFOR

(75) Inventors: Tohru Irie; Masashi Ota, both of Aichi (JP)

(73) Assignee: Sango Co., Ltd., Nagoya (JP)

( * ) Notice: Subject to any disclaimer, the term of this patent is extended or adjusted under 35 U.S.C. 154(b) by 0 days.

(21) Appl. No.: 09/509,022

(22) PCT Filed: Jul. 19, 1999

(86) PCT No.: PCT/JP99/03876

§ 371 Date: Mar. 21, 2000

§ 102(e) Date: Mar. 21, 2000

(87) PCT Pub. No.: WO00/05007

PCT Pub. Date: Feb. 3, 2000

(30) Foreign Application Priority Data

Jul. 21, 1998 (JP) ..... 10-205150

(51) Int. Cl.[7] ..... B21D 22/14
(52) U.S. Cl. ..... 72/84; 72/100
(58) Field of Search ..... 72/78, 84, 85, 72/100

(56) References Cited

U.S. PATENT DOCUMENTS

| | | | | |
|---|---|---|---|---|
| 1,297,819 A | * | 3/1919 | Ferrier | 72/100 |
| 2,358,307 A | | 9/1944 | Dewey | |
| 3,851,515 A | * | 12/1974 | Hautau | 72/121 |
| 4,091,648 A | | 5/1978 | McCaslin | |
| 4,143,535 A | * | 3/1979 | Bouman | 72/121 |
| 4,563,887 A | | 1/1986 | Bressan et al. | |
| 5,372,028 A | | 12/1994 | Brilman et al. | |

FOREIGN PATENT DOCUMENTS

| | | |
|---|---|---|
| EP | 0 528 984 A | 3/1993 |
| JP | 4-46647 | 2/1992 |
| JP | 10-24323 | 1/1998 |

OTHER PUBLICATIONS

Patent Abstracts Of Japan, vol. 010, No. 138 (M–480), May 21, 1986 & JP 60 261608 A (Nihon Spindle Seizou KK), Dec. 24, 1985 cited in the application abstract.

* cited by examiner

*Primary Examiner*—Lowell A. Larson
(74) *Attorney, Agent, or Firm*—Pillsbury Winthrop LLP

(57) ABSTRACT

According to the spinning processing method of the invention, a steel tube (4) as a work is rotated round its longitudinal axis (X). A plurality of forming rollers (23), which are arranged around the steel tube (4), are rotated round the steel tube axis (X) in the direction (β) opposite to the direction of rotation for the steel tube (4). The forming rollers 23 are further moved toward the steel tube axis (X) into pressure contact with the steel tube (4), while being moved relatively to the steel tube (4) in the axial direction (A–B) thereof, to draw the steel tube (4) to form a section of reduced diameter. The relative rotation of the steel tube (4) and the forming rollers (23) in the opposite directions (α, β) increases the relative rotation speed between them and shortens the processing time.

11 Claims, 4 Drawing Sheets

SPINNING PROCESSING METHOD AND APPARATUS THEREFOR

DESCRIPTION

This application is the national phase of international application PCT/JP99/03876 filed Jul. 19, 1999 which designated the U.S.

1. Technical Field

This invention relates to a spinning processing method, and more particularly to a spinning processing method in which a metal tube is drawn to form a section of reduced diameter and an apparatus therefor.

2. Background Art

A spinning processing method in which a steel tube is necking-processed to form a section of reduced diameter is disclosed in Japanese Patent Post-Exam. Publication No. H4-46647. According to this method, as shown in FIGS. 4 and 5, a plurality of forming rollers 103 are arranged around a steel tube 102, which is held by chuck 101, and the forming rollers 103 are rotated round the stationary steel tube 102 in the direction of an arrow C in FIG. 5. These rollers 103 are fed in the direction E along the tube axis, while being moved in the radially inward direction D of the steel tube 102, to form a section 104 of reduced diameter.

Another spinning processing method is disclosed in Japanese Patent Application Laid-Open Publication No. H10-24323. This method, contrarily to the above, rotates not forming rollers but a steel tube round its axis to perform the forming.

DISCLOSURE OF INVENTION

By the way, there are cases where, due to demands from the standpoint of manufacture, processing speed is required to be increased to thereby shorten processing time. In a spinning processing method, a processing speed is determined more by a rotating speed than by a feeding speed. In order to increase the processing speed, in the conventional methods wherein either a metal tube as the work or forming rollers are rotated, it is necessary to increase the rotating speed of the metallic tube or the forming rollers.

The present inventors have found that it is difficult to greatly reduce a processing time in the conventional spinning processing methods. This is because that even if intending to increase the rotating speed of the work or the forming rollers, because the rotational inertia of a chucking mechanism or a forming roller driving mechanism is large, it is impossible to greatly increase the rotating speed.

In particular, in the conventional spinning processing method which rotates the forming rollers round the work, the roller driving mechanism is relatively complicated and heavy, thereby making the inertia problems serious. Furthermore, the rollers will be subjected to a larger centrifugal force as their rotating speed increases, which prevents their motion in the forming direction, i.e., the radially inward direction of the work. For these reasons, not only the rotating speed of the forming rollers can not be increased greatly, but also some measures are required against the increase of the centrifugal force to thereby inevitably increase the cost of the forming machine.

It is an object of the present invention to provide a method of spinning processing which solves the above problems and increases the relative rotation speed between a work and forming rollers to greatly reduce processing time.

Another object of the invention is to provide a spinning processing apparatus which can carry out the above method.

The spinning processing method of the invention comprises the steps of rotating a metal tube round its longitudinal axis, rotating a plurality of forming rollers round the axis of the metal tube in the direction opposite to the metal tube, which rollers are arranged around the metal tube, moving the forming rollers towards the axis of the metal tube into pressure contact with the metal tube while moving the forming rollers in the axial direction of the metal tube relatively thereto to draw the metal tube to form a section of reduced diameter.

In the spinning processing method of the invention, since both the metal tube as the work and the forming rollers are rotated in the opposite directions to each other, the relative rotation speed between them comes to be high. For example, when setting the rotating speeds of the metal tube and the forming rollers identical, the relative rotation speed becomes twice.

The metal tube and the forming rollers, however, are not necessarily rotated at the same speed, and they may be rotated at different rotating speeds.

Furthermore, the relative movement between the forming rollers and the metal tube can be achieved by moving the rollers themselves, or the metal tube to the contrary, or both of them in the axial direction. Moving the metal tube alone allows the relative movement in the axial direction to be done easily and quickly as compared with the case where the relatively heavier forming roller driving mechanism is moved. On the other hand, in the arrangement wherein the forming rollers are moved, an automatic work exchanging mechanism is set up more easily, because the metal tube is stationary in the axial direction. Moving both the work and the forming rollers increases the relative movement speed between them and hence the feeding rate per time.

The spinning processing apparatus according to another aspect of the invention comprises means for supporting and rotating a metal tube round its longitudinal axis, a plurality of forming rollers arranged around the metal tube, means for rotating the forming rollers round the metal tube axis in the opposite direction to the metal tube, means for moving the forming rollers towards the metal tube axis into pressure contact with the metal tube, and means for moving the forming rollers relatively to the metal tube.

With this apparatus, the processing method of the invention described above can be carried out.

BRIEF DESCRIPTION OF DRAWINGS

Embodiments of the present invention will be now described with reference to accompanying drawings, in which.

BEST MODE FOR CARRYING OUT THE INVENTION

Figure 1:
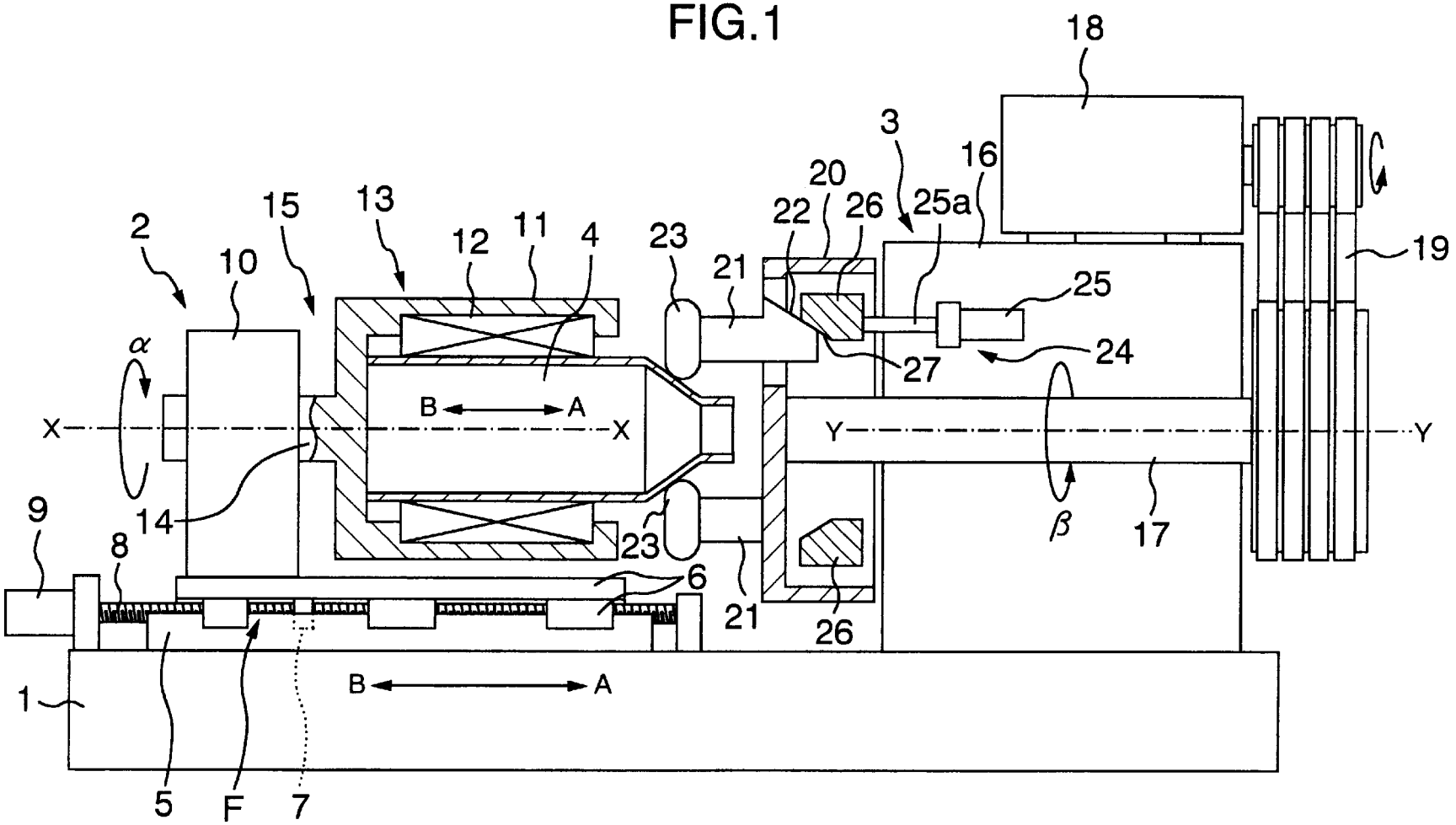
FIG. 1 is a side sectional view showing the spinning processing apparatus according to an embodiment of the invention.

FIG. 1 shows the spinning processing apparatus according to the first embodiment of the invention. The apparatus comprises a flat base 1, on one side of the base, a work driving section 2 is provided, and on the other side, a roller driving section 3 is provided.

Slide rails 5 are fixedly mounted on the base 1 on the side of the work driving section 2 along the direction A–B of the longitudinal axis of a work, i.e., a steel tube 4 in this embodiment, which is set up in the apparatus. A slider 6 is mounted on the slide rails 5 for slide motion along the axial direction A–B. A ball spline shaft 8 is screwed into a boss 7 on the slider 6. The ball spline shaft 8 is rotated in a forward or backward direction by drive means 9 such as a motor or the like to move the slider 6 back and forth for a desired travel in the axial direction A–B. These components form means F for moving the work in its axial direction.

A rotation-driving device 10, with built-in rotary means such as a driving motor or the like, is fixed on the slider 6. The rotation-driving device 10 has work-supporting means that comprises a cylindrical work-supporting arm 11 and a chuck 12 provided within the arm. The work-supporting arm 11 is connected, via its rotating shaft 14, to the rotary means, e.g., a motor, in the rotation-driving device 10, to be rotated in a specified direction α.

The chuck 12 is adapted to hold and release the steel tube 4 by means of a chuck-driving means, is not shown. The chuck 12 is disposed such that when it holds the steel tube 4, its axis X—X is in line with the rotation axis of the rotating shaft 14 and the steel tube 4 is rotated round the rotation axis. These components form means 15 for supporting and rotating the work round the axis.

A rotary equipment section 16 is provided on the base 1 on the side of the roll-driving section 3. The rotary equipment section 16 includes a rotating shaft 17, which can be rotated with its axis Y—Y aligned coaxially with the axis X—X of the steel tube. The shaft 17 is rotated by rotation-driving means 18, which comprises a motor, via belts 19 in the direction β that is opposite to the direction α for the rotating shaft 14. A cylindrical roll holder 20 for a plurality of forming rollers 23 is fixed on the rotating shaft 17 on the side of the work-driving section 2. The roll holder 20 is adapted to rotate round the axis Y—Y thereof in the direction β by the driving of the rotating shaft 17. These components form means for rotating the forming rollers round the work.

The roll holder 20 is provided with a plurality of brackets 21, three in this embodiment, are arranged at equal intervals in the circumferential direction of the roll holder 20 with their axes laying in parallel to the axis Y—Y, and they are adapted to rotate together with the roll holder 20 in the direction β. Each bracket 21 is movable in the radial direction centering on the axis Y—Y of the roll holder 20, or in the radial direction of the steel tube 4.

Each bracket 21 has an end positioned within the roll holder 20, which end is formed on its side facing radially outward with a tapered face 22. Each bracket 21 is further provided with means for always pressing the bracket 21 towards the outer periphery of the roll holder 20, e.g., a return spring, which is not shown. Furthermore, the forming roller 23 is mounted on the outer end of each bracket 21 in a manner that the forming roller 23 itself freely rotates, that is, can rotates round its axis.

The rotary equipment section 16 contains locus-changing means 24 which changes the rotation locus of the forming rollers 23. The means 24 comprises a cylinder 25 serving as driving means and a ring plate 26 which is connected to the end of a rod 25*a* of the cylinder 25. The ring plate is situated within the roll holder 20 so as not to interfere with the rotation of the roll holder 20. The ring plate 26 is in an annular shape concentric with the rotating shaft 17. The inner side of the end of the ring plate is formed with a tapered face 27 flaring radially outward and engages with the tapered faces 22 of the brackets 21.

As the ring plate 26 moves forward to the left in FIG. 1 by the driving of the cylinder 25, its tapered face 27 pushes the tapered faces 22 of the brackets 21 radially inward. As a result, all the brackets 21 and hence all the forming rollers 23 move towards the rotating shaft 17 for the same distance. On the other hand, when the ring plate 26 moves backward to the right in FIG. 1, each forming roller 23 travels in the radially outward direction for the same distance.

Next, the spinning processing for forming a section of reduced diameter on the steel tube by the above apparatus will be described.

Before stating the processing, the slider 6 lies on the left side of the position shown in FIG. 1, where a blank steel tube 4 is held by the chuck 12. Furthermore, the ring plate 26 lies on the right side of the position shown in FIG. 1, and the respective forming rollers 23 are pushed radially outward apart from the blank steel tube 4 by the return springs which are not shown.

In this state, the rotation-driving device 10 is operated to rotate the blank steel tube 4 round its axis in a fixed direction, for example, in the direction α. At the same time, the rotation-driving means 18 is operated to rotate the rotating shaft 17 in the direction β, which is opposite to the direction α for the steel tube 4. The respective forming rollers 23 rotate together with the roll holder 20 round the steel tube 4 in the direction β.

Then, the ball spline shaft 8 is rotated by the driving means 9 to move the slider 6 and the steel tube 4 in the direction of an arrow A. Further, the cylinder 25 is operated to move the ring plate 26 forward. Each forming roller 23 is moved in the radially inward direction of the steel tube 4, through the engagement of the tapered face 22 with the tapered face 27 of the ring plate 26, to gradually decrease its rotation locus around the steel tube. As a result, the respective forming rollers 23 rotate round the axis X—X, while being in pressure contact with the outer periphery of the steel tube 4 and each rotating round their own axes. At the same time, the forming rollers 23 gradually decrease their rotation locus to draw the steel tube 4 to reduce its outer diameter.

During the spinning processing, the steel tube 4 and the forming rollers 23 rotate in the opposite directions to each other, and the relative rotation speed between them is high. That is, when setting the steel tube 4 and each forming roller 23 at the same rotating speed, the relative rotation speed becomes twice as high as that of the steel tube 4 and the forming roller 23.

Normally, the relative rotation speed is dominant in the length of the spinning processing time, and increasing the relative rotation speed twice can essentially halve the processing time. Furthermore, it is not necessary to greatly increase the speed at which the forming rollers 23 rotate round the axis X—X, because it can be half of the relative rotation speed. Therefore, there are caused no such problems as involved in the conventional methods in which the rotating speed of the forming rollers or the work alone has to be increased for the same end.

Incidentally, the rotating speed of the steel tube 4 is not necessarily the same as that of the forming rollers 23, and each speed can be set discretionarily. It is possible, for example, to set a lower speed for one of the work rotating mechanism and the forming roller rotating mechanism, whose inertia is larger, and to increase the rotation of the other accordingly to keep the same relative rotation speed.

During the spinning processing, the steel tube 4 is forcefully subjected to a rotational force, which is opposite in direction to the rotation of the forming rollers 23 round the axis X—X. The steel tube 4 tends to contract due to the resultant tensile force and twisting force generated therein not to increase its size, and a desired shape and size can be achieved surely.

Further, setting the relative rotation speed notably higher than the feeding speed of the steel tube 4 in the axial direction can reduce the deviation between the spiral locus and the roller angle of the forming rollers 23 to a negligible level. It therefore becomes unnecessary to provide a special device for the forming rollers, i.e., attaching of the forming rollers at an angle as seen in Japanese Patent Application Laid-Open Publication No. H10-24323.

In this embodiment, the forming rollers 23 are kept stationary in the axial direction, and the steel tube 4 alone is moved in the axial direction. Accordingly, the relative movement between the work and the forming rollers in the axial direction can be made easily and quickly as compared with the case where the relatively heavier mechanism for the forming rollers is moved. In particular, by rotating and stopping only the mechanism for the work to perform the processing without stopping the rotation of the mechanism for the forming rollers, which has a larger inertia, and without moving the same in the axial direction, an efficient and continuous processing can be realized.

Figure 2:
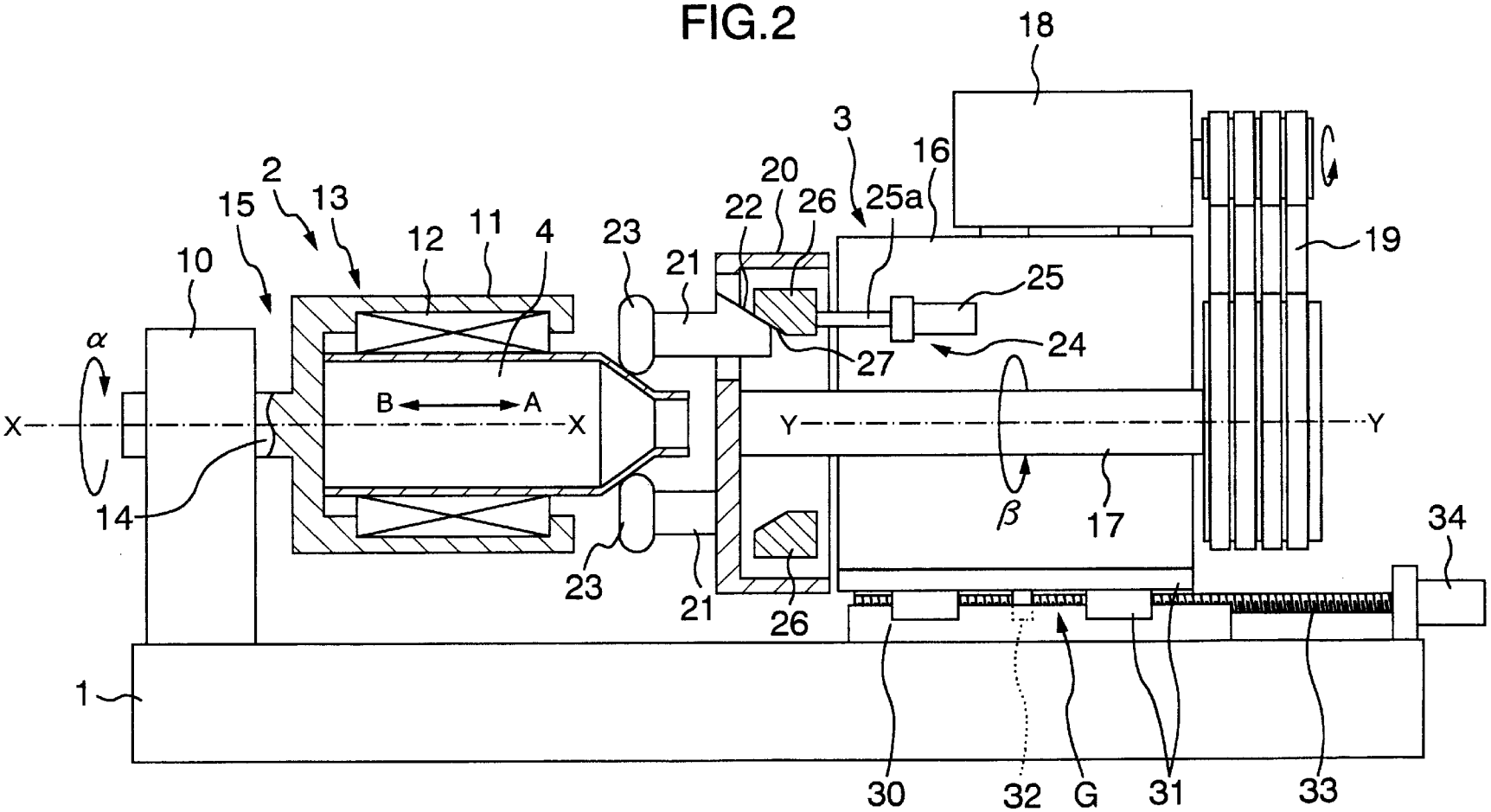
FIG. 2 is a side sectional view showing the spinning processing apparatus according to another embodiment of the invention.

FIG. 2 illustrates the spinning processing apparatus according to the second embodiment of the invention. This embodiment includes, on the roll driving section 3 side, means G for moving the forming rollers 23 in the axial direction A–B, in place of the means F for moving the work in the axial direction in the work driving section 2 of the first embodiment, which comprises the slider 6, the spline shaft 8, the driving means 9, etc.

More specifically, slide rails 30 are fixed on the base 1 on the side of the roll driving section 3 along the axial direction A–B. A slider 31 is mounted on the slide rails 30 slidably in the axial direction A–B. A ball spline shaft 33 is screwed into a boss 32 on the slider 31, and the ball spline shaft 33 is connected with driving means 34, such as a motor. By operating the driving means 34 to rotate the ball spline shaft 33 forward or backward for a desired travel, the slider 31 moves back or forth to a desired distance in the axial direction A–B.

The other structure of the second embodiment is similar to the first embodiment, and the same reference numerals are given to the similar portions to omit the explanations.

The spinning processing method using this apparatus, similarly to the first embodiment, comprises the step of holding and rotating the steel tube 4 in the fixed direction $\alpha$. The forming rollers 23 are rotated in the opposite direction $\beta$ to the direction $\alpha$ of rotation for the steel tube 4, while gradually decreasing their rotation locus. The processing method, although these steps are the same with the first embodiment, is different therefrom in that the relative movement between the steel tube 4 and the forming rollers 23 is caused by moving the mechanism for the forming rollers while keeping the mechanism for the work stationary. More specifically, the driving means 34 drives the rotary equipment section 16 forward or backward in the axial direction to move the forming rollers 23 together with the roll holder 20 and so forth in the axial direction A–B.

Also in this embodiment, the steel tube 4 and the forming rollers 23 are rotated in the opposite directions to each other to enlarge the relative rotation speed between them, thereby achieving similar functions and effects to those of the first embodiment described above.

Furthermore, in the second embodiment, the mechanism for the work is stationary with respect to the axial direction, and when providing an automatic work exchanging mechanism, it can be combined easily.

Figure 3:
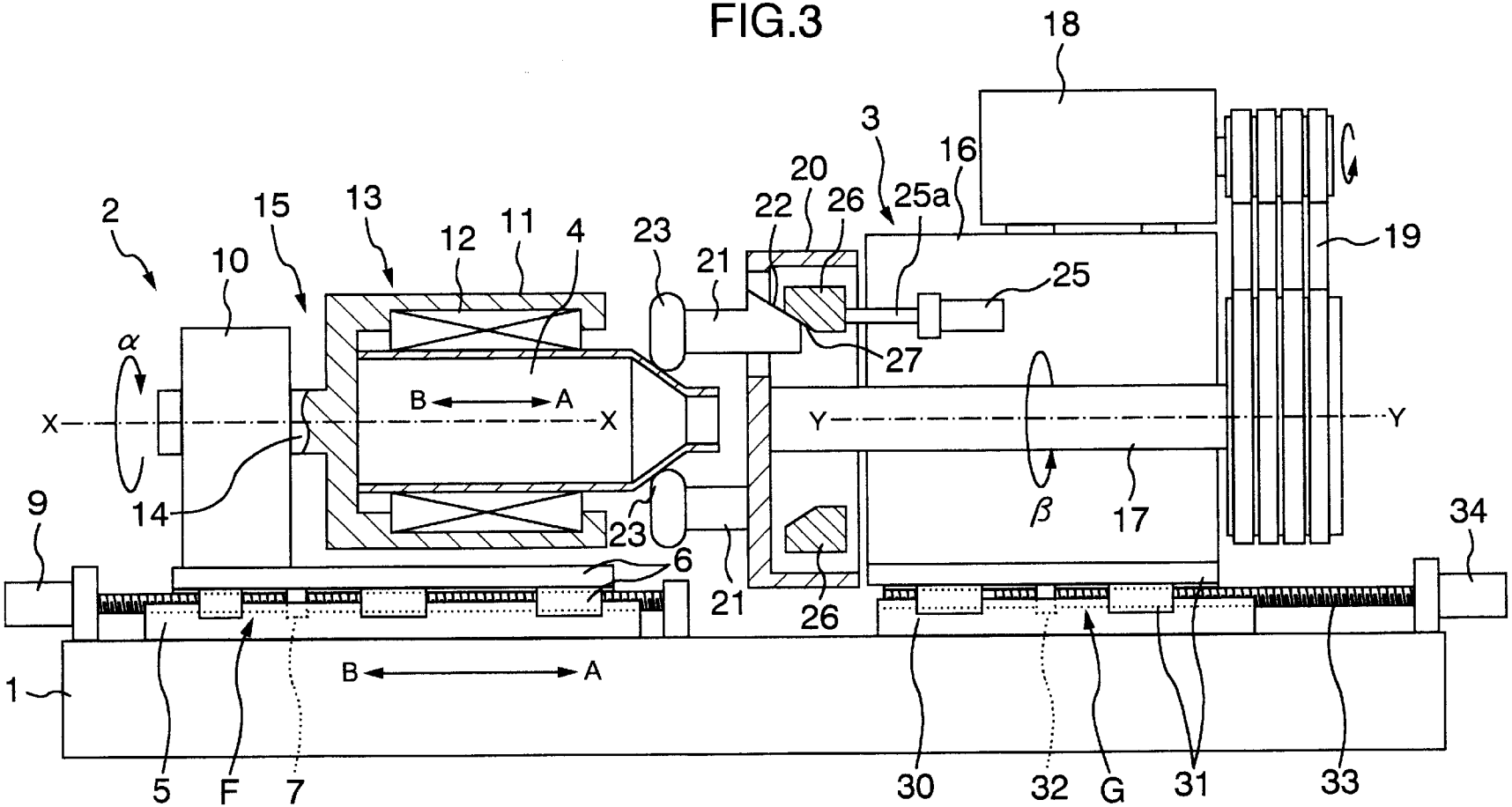
FIG. 3 is a side sectional view showing the spinning processing apparatus according to still another embodiment of the invention.
Figure 4:
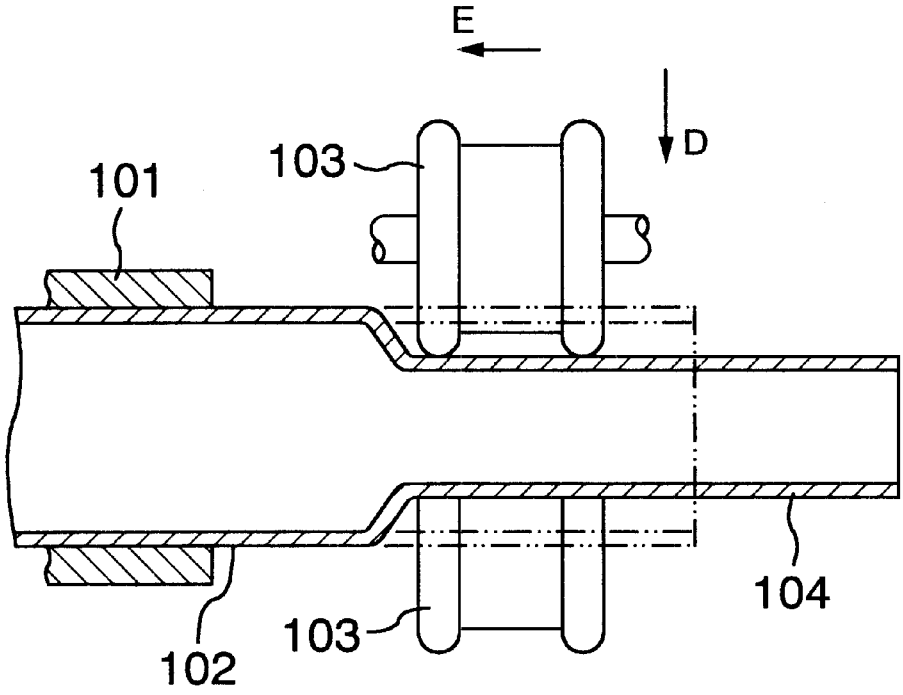
FIG. 4 is a side sectional view schematically showing the essential part of a conventional spinning processing apparatus.
Figure 5:
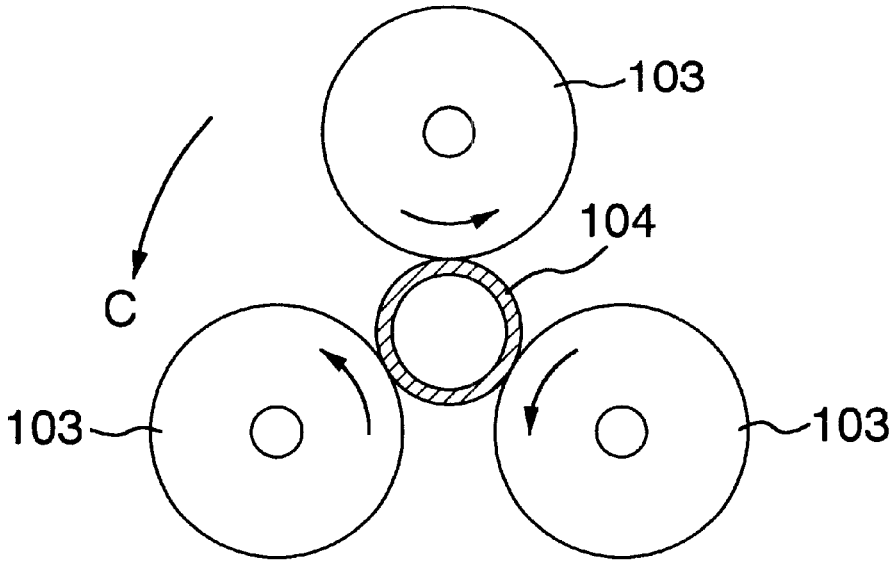
FIG. 5 is a front view of the essential part of FIG. 4.

FIG. 3 shows the spinning processing apparatus according to the third embodiment of the invention. The apparatus has, on the work driving section 2 side, means F for moving the work in the axial direction, which is similar to that of the first embodiment, and on the roller driving section 3 side, means G for moving the forming rollers 23 in the axial direction, which is similar to that of the second embodiment. Portions of this embodiment, which are similar to the first and the second embodiment, are given the same reference numerals to omit the explanation.

Also in the third embodiment, the relative rotation speed between the steel tube 4 and the forming rollers 23 is high due to their rotation in the opposite directions, and similar functions and effects to those of the embodiments described above can be obtained.

Moreover, in this embodiment, as both the mechanisms for the work and for the forming rollers are moved in the directions approaching each other, the relative feeding or moving speed in the axial direction A–B increases. Accordingly, in addition to the increase of the relative rotation speed between the work and the forming rollers, the processing time is shortened further. When the apparatus is so designed as to feed the work and the forming rollers independently, the relative movement speed can be freely changed during the processing over a wider range than that associated with the usual processing, thereby increasing freedom of the processing.

Incidentally, the mechanisms for holding and rotating the work, for moving the forming rollers in the axial direction, for controlling the radial movement of the forming rollers, for rotating the forming rollers round the work, and for moving the forming rollers in the axial direction are not limited to those of the above embodiments, and other structures may be employed. Further, a core metal having an outer diameter almost the same as the inner diameter of the section of reduced diameter to be formed may be extended concentrically from the work-supporting arm 11 and/or the roll holder 20, in order to improve the dimensional accuracy of the section of reduced diameter. Moreover, although all the embodiments have been described to process the steel tube as a work, other metal tube such as aluminum and copper tubes and the like can be of course processed in a similar manner.

Furthermore, the present invention is not limited to the spinning processing for the end of a tube as illustrated but is of course applicable to other products which have hitherto been manufactured by spinning processing, such as vehicle wheels, clutch drums, pulleys and gear wheels all involving flow forming.

As having described above, according to the invention, both the work and the forming rollers are rotated in the opposite directions to each other, and therefore, the relative rotation speed between them becomes high. As the relative rotation speed is dominant in the length of the spinning processing time, the spinning processing method of the invention reduces the processing time. For example, by rotating the work and the forming rollers in the opposite directions at the same speed, the relative rotation speed between them becomes twice, and the processing time can be reduced to almost a half. Accordingly, the processing time can be reduced greatly as compared with the conventional methods according to which either one of the forming rollers and the work is rotated. This reduction can be realized without causing the harmful result from increasing of the rotating speed of the forming rollers as is in the conventional method.

Further, when the apparatus is so designed as to enable the mechanism for the work alone to move in the axial direction, the movement can be made easily and quickly as compared with the case where the relatively heavier mechanism for the forming rollers is moved. In particular, an efficient and continuous processing can be realized by rotating and stopping only the mechanism for the work without stopping the rotation of the mechanism for the forming rollers to keep its operation continuous, which has a larger inertia.

Alternatively, however, the mechanism for the forming rollers alone, or both the mechanisms for the work and for the forming rollers may be designed movable in the axial direction. In the former design, when providing an automatic work exchanging mechanism, it can be installed easily, because the mechanism for the work is stationary in the axial direction. In the latter design, the relative movement speed between the work and the forming rollers can be increased to further reduce the processing time.

The best modes for carrying out the invention have been described with reference to the accompanying drawings, but the spinning processing method and apparatus of the invention are not limited solely to those. It should be understood that a variety of changes and modifications can be made within the scope of accompanying claims.

What is claimed is:

1. A spinning processing method, comprising:

rotating a metal tube round a longitudinal axis thereof;

rotating a plurality of forming rollers, arranged around the metal tube, round the longitudinal axis of the metal tube in a direction opposite to a direction of rotation of the metal tube; and radially driving the forming rollers toward the metal tube longitudinal axis to forcibly push the forming rollers on the metal tube by means of a driving mechanism, while moving the forming rollers relatively to the metal tube in an axial direction thereof, to draw the metal tube to form a section of reduced diameter.

2. The method according to claim 1, wherein the metal tube and the forming rollers are rotated at the same speed.

3. The method according to claim 1, wherein the metal tube and the forming roller are rotated at different speeds.

4. The method according to claim 1, wherein the relative movement of the forming rollers to the metal tube is made by moving the metal tube in the axial direction thereof.

5. The method according to claim 1, wherein the relative movement of the forming rollers to the metal tube is made by moving the forming rollers in the axial direction of the metal tube.

6. The method according to claim 1, wherein the relative movement of the forming rollers to the metal tube is made by moving both the metal tube and the forming rollers in the axial direction of the metal tube.

7. A spinning processing apparatus for forming a section of reduced diameter in a metal tube, comprising:

means for supporting and rotating the metal tube round a longitudinal axis thereof;

a plurality of forming rollers arranged around the metal tube;

means for rotating said forming rollers round the longitudinal axis of the metal tube in a direction opposite to a direction of rotation for the metal tube;

a driving mechanism for radially driving the forming rollers toward the metal tube longitudinal axis to forcibly push the forming rollers on the metal tube; and means for moving the forming rollers relatively to the metal tube in an axial direction thereof.

8. The apparatus according to claim 7, wherein said means for relatively moving the forming rollers comprise means for moving the metal tube in the axial direction thereof.

9. The apparatus according to claim 7, wherein said means for relatively moving the forming roller comprises means for moving the forming rollers in the axial direction of the metal tube.

10. The apparatus according to claim 7, wherein said means for relatively moving the forming rollers comprises means for moving the metal tube in the axial direction thereof and means for moving the forming rollers in the axial direction of the metal tube.

11. A spinning processing method, comprising:

rotating a metal tube around a longitudinal axis thereof;

rotating a plurality of forming rollers, arranged around the metal tube, round the longitudinal axis of the metal tube in a direction opposite to a direction of rotation of the metal tube;

radially moving the forming rollers toward the metal tube longitudinal axis into pressure contact with the metal tube, while moving the forming rollers relatively to the metal tube in an axial direction thereof, to draw the metal tube to form a section of reduced diameter; and during moving the forming rollers radially and relatively to the metal tube, setting a relative rotation speed between the forming rollers and the metal tube higher than a relative moving speed between the forming rollers and the metal tube in the axial direction so that a deviation between a spiral locus and a roller angle of the forming rollers is reduced to a negligible level.

* * * * *